US011079111B2

(12) United States Patent
Verduzco et al.

(10) Patent No.: US 11,079,111 B2
(45) Date of Patent: Aug. 3, 2021

(54) AIR TUBE

(71) Applicant: Solar Turbines Incorporated, San Diego, CA (US)

(72) Inventors: German Verduzco, San Diego, CA (US); Michael Telfer, San Diego, CA (US); Drew Dominique, Lakeside, CA (US); James Peffley, Santee, CA (US); Taher Basrai, San Diego, CA (US); Rasoul Paydar, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 96 days.

(21) Appl. No.: 16/397,999

(22) Filed: Apr. 29, 2019

(65) Prior Publication Data

US 2020/0340673 A1 Oct. 29, 2020

(51) Int. Cl.
*F23R 3/04* (2006.01)
*F23R 3/50* (2006.01)

(52) U.S. Cl.
CPC ..... *F23R 3/045* (2013.01); *F23R 3/50* (2013.01)

(58) Field of Classification Search
CPC .... F23R 3/045; F23R 3/50; F23R 3/12; F23R 3/16
See application file for complete search history.

(56) References Cited

U.S. PATENT DOCUMENTS 3,744,242 A * 7/1973 Stettler ..... F23C 9/006 60/39.23
4,887,432 A * 12/1989 Mumford ..... F23R 3/06 60/759
4,891,936 A 1/1990 Shekleton et al.
5,113,647 A * 5/1992 Shekleton ..... F23R 3/045 60/804
5,966,926 A 10/1999 Shekleton et al.
6,729,141 B2 5/2004 Ingram
6,931,862 B2 8/2005 Harris
8,646,277 B2 2/2014 Chila et al.
9,534,790 B2 * 1/2017 Cai ..... F23R 3/14
9,803,863 B2 * 10/2017 Johnson ..... F23R 3/045
2010/0212324 A1 * 8/2010 Bronson ..... F23R 3/06 60/752
2013/0098044 A1 * 4/2013 Singh ..... F23R 3/045 60/742
2013/0174558 A1 * 7/2013 Stryapunin ..... F23R 3/002 60/734
2014/0202163 A1 7/2014 Johnson et al.
2017/0023252 A1 * 1/2017 Tanaka ..... F23R 3/28
2017/0219212 A1 * 8/2017 Laster ..... F02C 3/30
2018/0252410 A1 9/2018 Zelina et al.
(Continued)

FOREIGN PATENT DOCUMENTS

EP 2584268 A2 4/2013
WO 2018026382 A1 2/2018

*Primary Examiner* — Ehud Gartenberg
*Assistant Examiner* — Henry Ng
(74) *Attorney, Agent, or Firm* — Procopio, Cory, Hargreaves & Savitch LLP

(57) ABSTRACT

This disclosure provides an air tube for a combustor of a gas turbine engine. The air tube includes an inner tube and an outer tube to deliver discharged compressor air into a combustion chamber of the combustor. The air tube can include struts and fins that can improve the cooling performance of the air tube during operation of the gas turbine engine.

16 Claims, 5 Drawing Sheets

(56) References Cited

U.S. PATENT DOCUMENTS

| | | | | |
|---|---|---|---|---|
| 2018/0304281 | A1* | 10/2018 | Wirtz | F23R 3/14 |
| 2018/0363907 | A1 | 12/2018 | Purcell et al. | |
| 2019/0178496 | A1* | 6/2019 | Jones | F23C 6/047 |
| 2019/0226680 | A1* | 7/2019 | North | F23R 3/286 |

* cited by examiner

AIR TUBE

TECHNICAL FIELD

This disclosure relates to gas turbine engines. More specifically, this disclosure relates to an air tube for a gas turbine engine.

BACKGROUND

Gas turbine engines can use combustors with combustor liners that include air tubes. These air tubes can feed post compressor discharge air into a primary zone of the combustor liner and promote tangential swirl. The air tubes can be difficult and expensive to manufacture via convention manufacturing methods to manufacture, lack consistency, and degrade over time.

U.S. Pat. No. 6,729,141, to Ingram describes air tubes that are circumferentially spaced around the outer liner of an annular combustor for a microturbine engine in proximity to and downstream of a dam extending into the combustion chamber for reducing the emission of NOx. The air tubes are dimensioned so that the length to passage diameter is such that a swirling motion of the air injected into the combustion zone is normal to the center line of the annular combustor.

The present disclosure is directed toward overcoming one or more of the problems discovered by the inventors.

SUMMARY

In general, this disclosure describes an air tube for a gas turbine including a combustor with an outer liner. The air tube comprises an inner tube, a strut, an outer plate, and an outer tube.

The inner tube circumferentially extends around an air tube axis longitudinal to the air tube. The inner tube has an outer surface, an inner tube inlet, and an inner tube outlet disposed opposite of the inner tube inlet, the inner tube outlet in fluid communication with the inner tube inlet. The strut is disposed adjacent to the outer surface of the inner tube and extends from proximate the inner tube inlet towards the inner tube outlet. The outer plate configured to be connected to the outer liner of the combustor. The outer tube connected to the strut and disposed outward of the inner tube.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description. In some instances, reference numbers are left out of the figures for ease of viewability.

Figure 1:
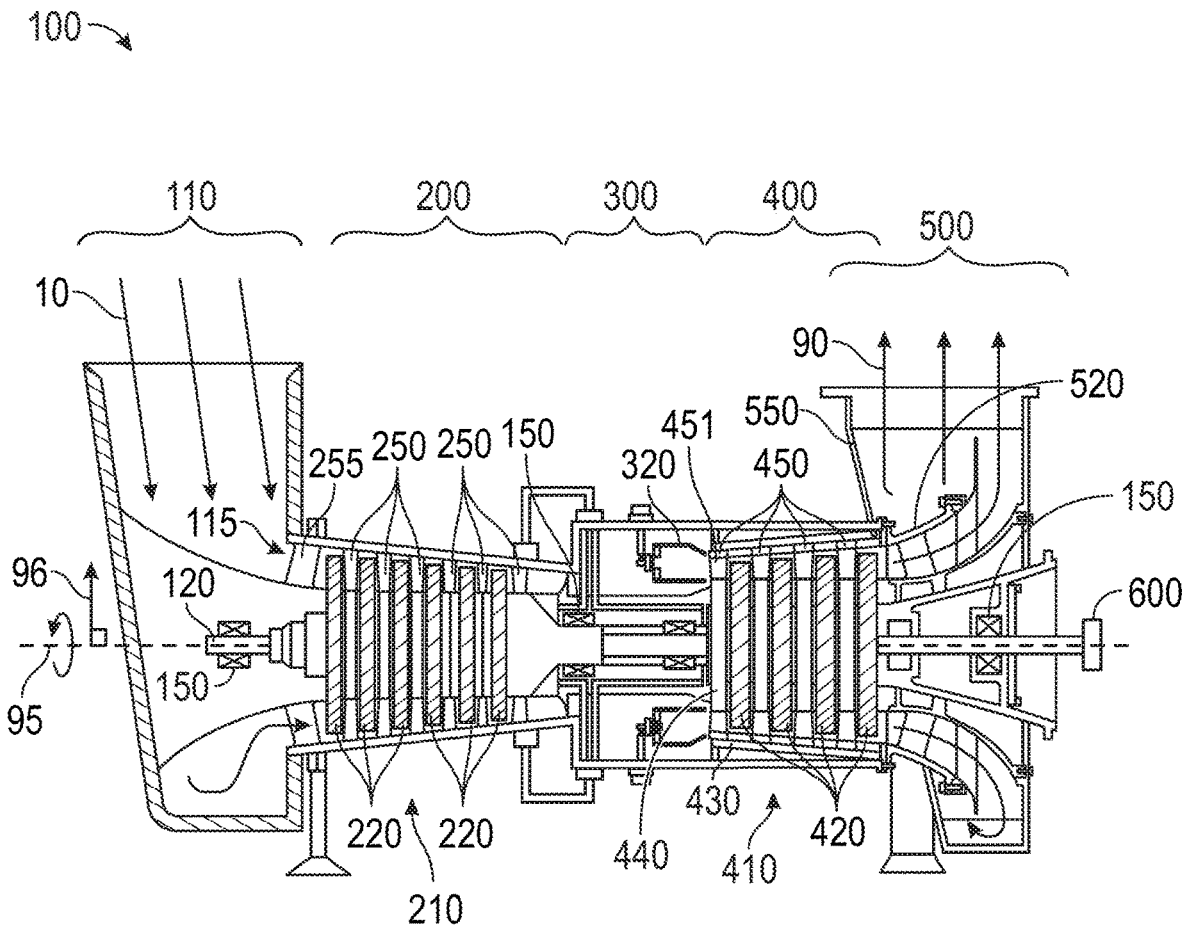
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air 10 (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages at the beginning of an annular flow path 115 through the gas turbine engine 100.

Once compressed air 10 leaves the compressor 200, it enters the combustor 300, where it is diffused and fuel is added. Air 10 and fuel are injected into a combustion chamber 320 via an injector and combusted. Energy is extracted from the combustion reaction via the turbine 400 by each stage of the series of turbine disk assemblies 420.

The turbine 400 includes a turbine rotor assembly 410 and turbine nozzles 450 within a turbine housing 430. The turbine rotor assembly 410 mechanically couples to the shaft 120. In the embodiment illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 520 and an exhaust collector 550 that can collect exhaust gas 90. The power output coupling 600 may be located at an end of shaft 120.

Figure 2:
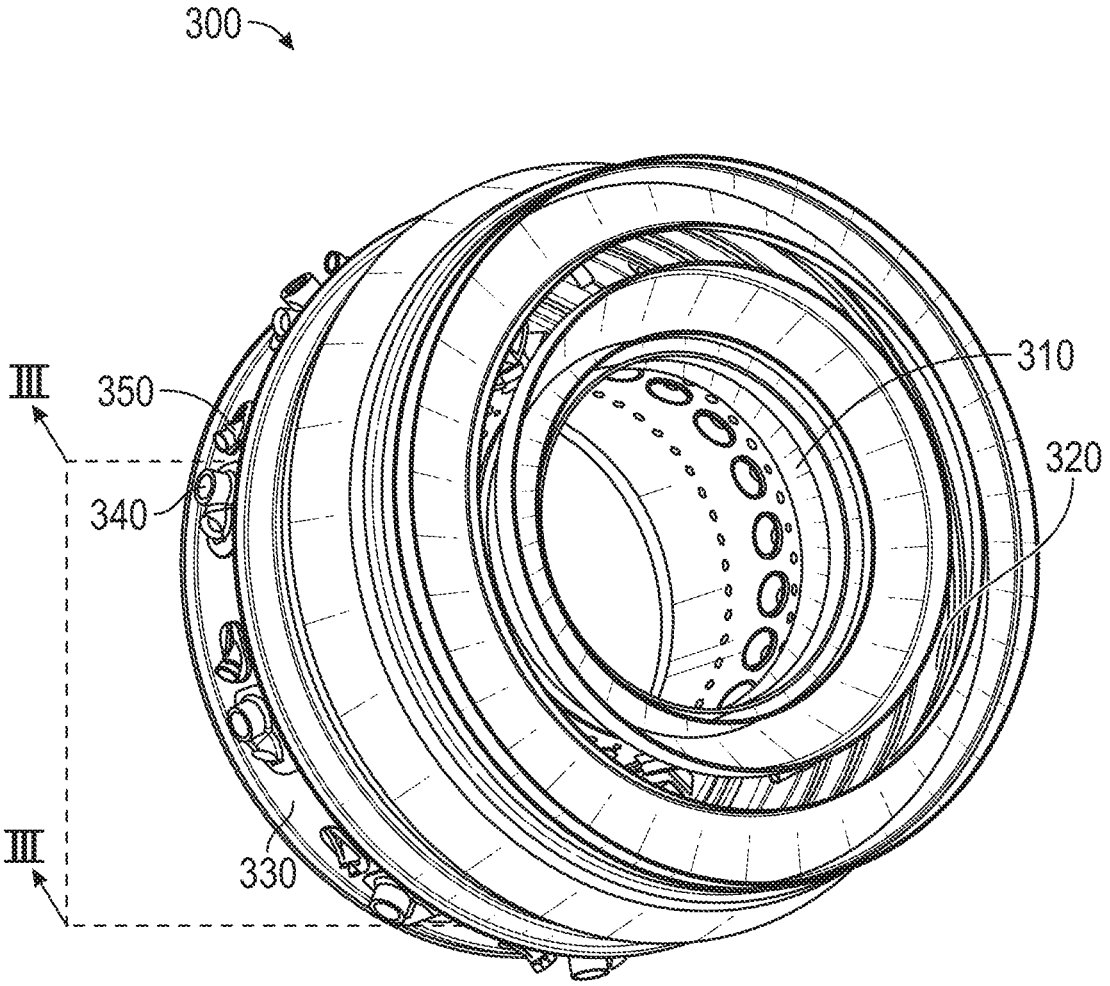
FIG. 2 is a perspective view of the combustor of the gas turbine engine of FIG. 1.

FIG. 2 is a perspective view of the combustor of the gas turbine engine of FIG. 1. The combustor 300 can have an annular shape and include an inner liner 310 and an outer liner 330. The inner liner 310 can circumferentially extend around the center axis 95 and form an annular shape such as a cylinder. The outer liner 330 can be disposed outward of the inner liner 310. The combustion chamber 320 can be formed between the inner liner 310 and outer liner 330.

Fuel nozzles 340 can be circumferentially disposed around the outer liner 330 and be in flow communication with the combustion chamber 320. Air tubes 350 can be circumferentially disposed around the outer liner 330 and be in flow communication with the combustion chamber 320. The air tubes 350 can be oriented at an angle with respect to the outer liner 330 such as less than 90 degrees with respect to the outer liner 330. The fuel nozzles 340 can be spaced between the air tubes 350 and may be spaced evenly. The air tubes 350 can comprise a wide variety of metals, including sheet metal and metals used for additive manufacturing such as Nickel based alloys.

Figure 3:
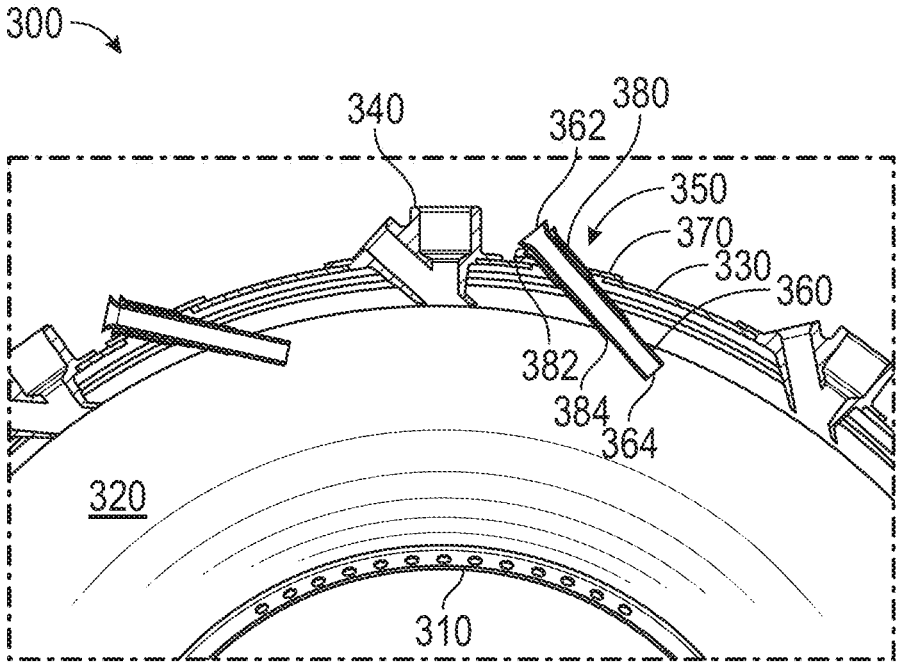
FIG. 3 is a cross section view of a portion of the combustor from FIG. 2 along plane III-III.

FIG. 3 is a cross section view of a portion of the combustor from FIG. 2. The fuel nozzles 340 and the air tubes 350 can partially extend through the outer liner 330 and into the combustion chamber 320. The air tube 350 can include an inner tube 360, an outer plate 370, and an outer tube 380. The inner tube 360 can be disposed within the outer tube 380. The inner tube 360 and outer tube 380 can be shaped as hollow cylinders such as cylindrical tubes. The inner tube 360 can have an inner tube inlet 362 and an inner tube outlet 364. The inner tube inlet 362 can be disposed outward of the outer liner 330 with respect to the center axis 95 and may not be located within the combustion chamber 320. The inner tube inlet 362 can be in flow communication with the compressor 200. The inner tube outlet 364 can be disposed inward of the outer liner 330 with respect to the center axis 95 and may be located within the combustion chamber 320. The inner tube outlet 364 can be in flow communication with the inner tube inlet 362. In other words, a portion of the inner tube 360 can extend through the outer liner 330.

The outer tube 380 can have an outer tube inlet 382 and an outer tube outlet 384. The outer tube inlet 382 can be disposed outward of the outer liner 330 with respect to the center axis 95 and may not be located within the combustion chamber 320. The outer tube inlet 382 can be in flow communication with the compressor 200. The outer tube outlet 384 can be disposed inward of the outer liner 330 with respect to the center axis 95 and may be located within the combustion chamber 320. The outer tube outlet 384 can be in flow communication with the outer tube inlet 382. In other words, a portion of the outer tube 380 can extend through the outer liner 330.

The outer plate 370 can be disposed outward of and circumferentially connected to the outer tube 380 with respect to the air tube axis 355. The outer plate 370 can be angled with respect to the outer tube 380. The outer plate 370 can be configured to be connected to the outer liner 330 of the combustor 300. The outer plate 370 can be connected to the outer liner 330 via brazing, welding, mechanical fasteners or other connections of the like.

Figure 4:
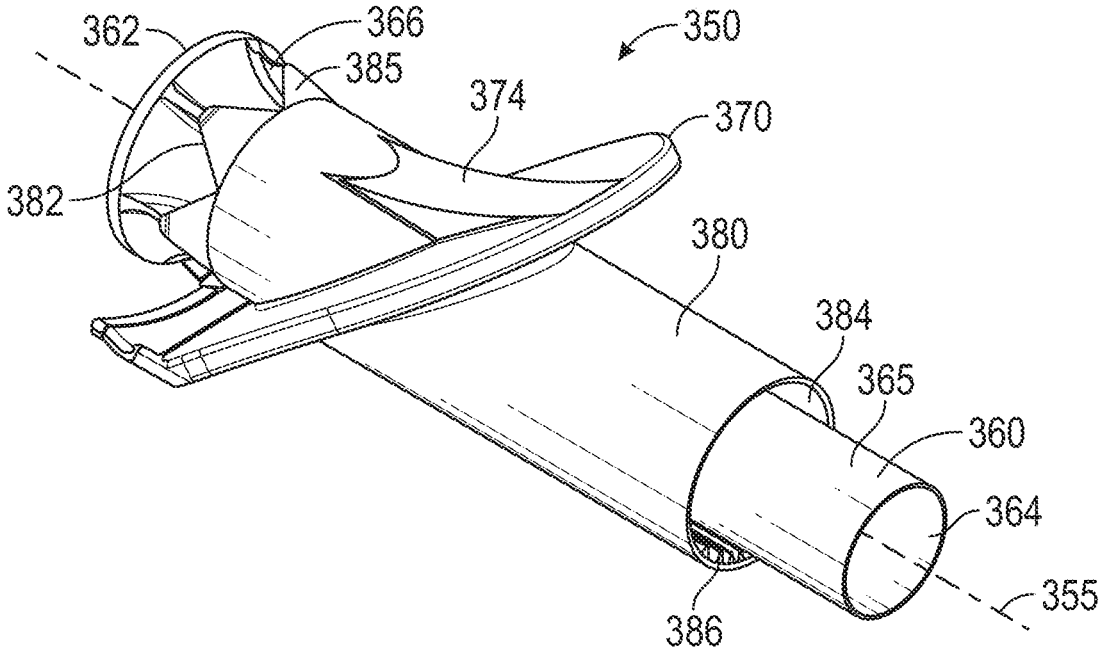
FIG. 4 is a perspective view of an exemplary air tube.

FIG. 4 is a perspective view of an exemplary air tube. The air tube 350 can have an air tube axis 355 that is longitudinal to the air tube 350. The inner tube 360 can circumferentially extend around the air tube axis 355 and generally be shaped as a hollow cylinder extending along the air tube axis 355. The inner tube 360 may flare outward proximate the inner tube inlet 362 with respect to the air tube axis 355 and may have a bell like shape. In other words, the inner tube 360 can be larger adjacent the inner tube inlet 362 than the inner tube outlet 364. The inner tube inlet 362 and inner tube outlet 364 may extend further along the air tube axis 355 than the outer tube inlet 382 and outer tube outlet 384 respectively. In other words, the outer tube inlet 382 and the outer tube outlet 384 are disposed axially between the inner tube inlet 362 and the inner tube outlet 364 with respect to the air tube axis 355.

The inner tube 360 can include an inner tube outer surface 365 facing outwards with respect to the air tube axis 355. The inner tube 360 can include struts 366 that are disposed proximate to the inner tube inlet 362 and extend outward from the inner tube outer surface 365 with respect to the air tube axis 355. The struts 366 can be positioned circumferentially around the inner tube 360 and be evenly spaced apart. Alternatively the struts 366 can vary in spacing and not be evenly spaced apart. The struts 366 can extend from the inner tube inlet 362 towards the inner tube outlet 364 generally parallel with the air tube axis 355. The struts can extend along a portion of the outer tube 380. Alternatively the struts may extend the full length of the outer tube 380. A portion of the struts 366 may connect with the outer tube 380. In other words, the struts 366 can couple the inner tube 360 to the outer tube 380.

The outer tube 380 can circumferentially extend around the air tube axis 355 and generally be shaped as a hollow cylinder extending along the air tube axis 355. The outer tube 380 can be disposed radially outward from the inner tube 360 with respect to the air tube axis 355. The outer tube 380 can include flares 385 disposed proximate to the outer tube inlet 382. The flares 385 can be shaped similar to a crown with each of the crown points extending along one of the struts 366. The flares 385 can connect with the struts 366 and may generally radially contour the shape of the struts 366 with respect to the air tube axis 355.

The air tube 350 can include a first transition portion 374 that may be disposed at an obtuse angle formed by outer tube 380 and the outer plate 370. The first transition portion 374 can arcuately extend from the outer tube 380 to the outer plate 370.

Figure 5:
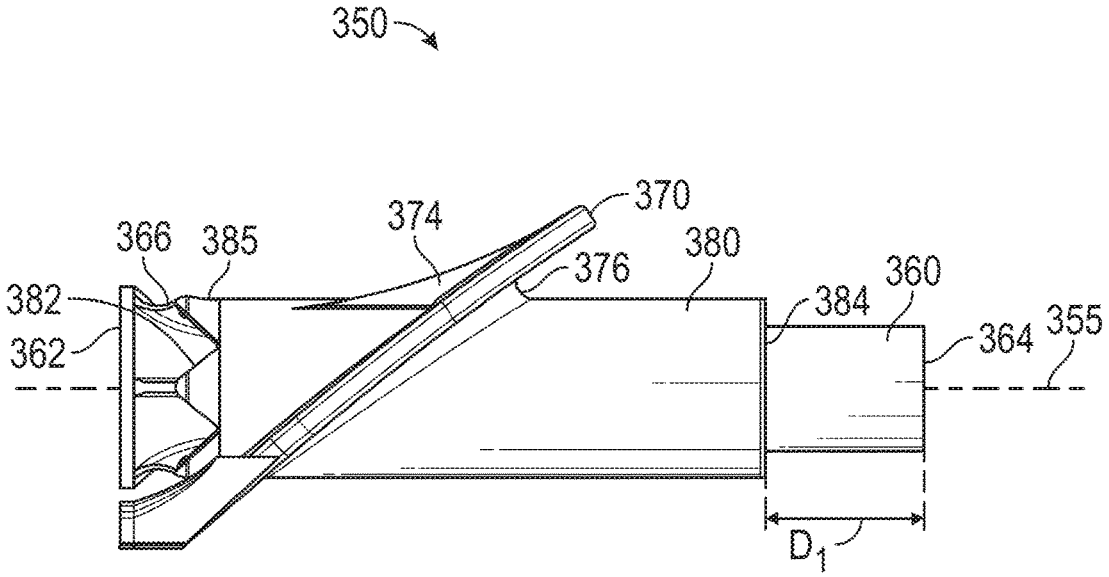
FIG. 5 is an elevation view of the air tube from FIG. 4.

FIG. 5 is an elevation view of the air tube from FIG. 4. The inner tube 360 can extend beyond the outer tube 380 at an emersion depth D1. The emersion depth D1 can vary in length and could extend more than one inch beyond the outer tube. The emersion depth D1 can range from zero to one inch. In another example the emersion depth D1 is negative and the outer tube 380 extends beyond the inner tube 360. The air tube 350 can include a second transition portion 376 that may be disposed at an acute angle formed by the outer tube 380 and the outer plate 370. The second transition portion 376 can arcuately extend from the outer tube 380 to the outer plate 370.

Figure 6:
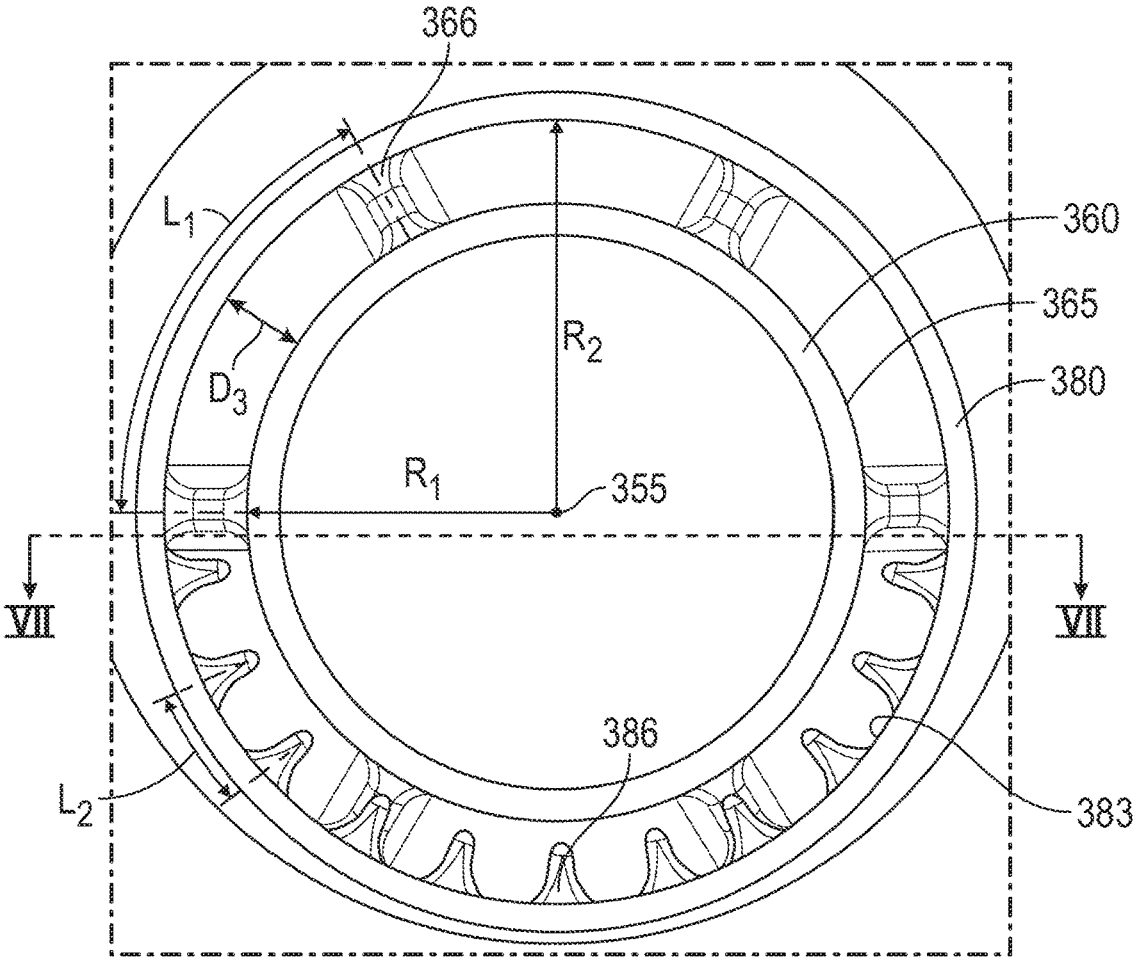
FIG. 6 is a portion of an end view of the air tube from FIG. 4 looking from the outer tube outlet towards the outer tube inlet.

FIG. 6 is an end view looking from the outer tube outlet towards the outer tube inlet of the air tube from FIG. 4. The inner tube 360 can have a radius R1 and the outer tube 380 can have a radius R2 larger than radius R1 with respect to the air tube axis 355. In other words, the inner tube 360 and outer tube 380 are concentric with each other. Alternatively, the inner tube 360 and outer tube 380 can vary in shape and may have multiple radii and curves such as with a teardrop shape. In another example, the inner tube 360 and outer tube 380 can be formed by geometry with straight lines such as a triangle, rectangle, hexagon, octagon, and other similar shapes.

The outer tube 380 can include an inner surface 383 facing inwards towards the inner tube 360 and the air tube axis 355. The outer tube 380 can include fins 386 that can extend inward from the inner surface 383 towards the inner tube 360 with respect to the air tube axis 355. In an embodiment, the fins 386 extend to proximate the inner tube 360 but do not connect with the inner tube 360. In an alternate example, the fins 386 extend from the outer tube 380 and connect with the inner tube 360.

The fins 386 can be positioned circumferentially around a portion of the outer tube 380 such as less than 180 degrees with respect to the circumference of the outer tube 380. Alternatively the fins 386 can be positioned greater than 180 degrees of the circumference of the outer tube 380. The fins 386 can be spaced apart along the outer tube 380 at a fin arc length L2. In an embodiment, the fins 386 are evenly spaced apart. Alternatively the fins 386 can vary in arc length L2 spacing and may not be evenly spaced apart. The fins 386 can extend from the outer tube outlet 384 towards the outer tube inlet 382 and be generally parallel with the air tube axis 355. The fins 386 can have a generally triangular shaped that is wider adjacent the outer tube 380 and narrower inward of the outer tube 380 with respect to the air tube axis 355. The fins 386 can have a concave fillet shape with the outer tube 380 such as a "T" fillet. Alternatively the fins 386 can be shaped as pin fins, wavy fins, rectangular cross-sectional fins, or a wide variety of other geometries that can provide different heat transfer characteristics.

In an embodiment eleven fins 386 are shown. However there is no limit to the number of fins 386 that can be included. One, two, three, four, five, six, or more fins 386 may be included.

The struts 366 can be positioned circumferentially around inner tube 360 and extend to the outer tube 380. The struts 366 can be spaced apart along the outer tube 380 at a strut arc length L1. In an embodiment, the struts 366 are evenly spaced apart. Alternatively the struts 366 can vary in arc length L1 spacing and may not be evenly spaced apart. The struts can have a generally "I" shape with concave fillets joining the outer tube 380 and the inner tube 360. In an embodiment six struts 366 are shown. However there is no limit to the number of struts 366 that can be included. One, two, three, four, five, seven, eight, or more struts 366 may be included.

The outer tube 380 and the inner tube 360 can be radially spaced apart at a distance D3. Distance D3 can be the difference between the inward tube radius R1 and the outer tube radius R2.

Figure 7:
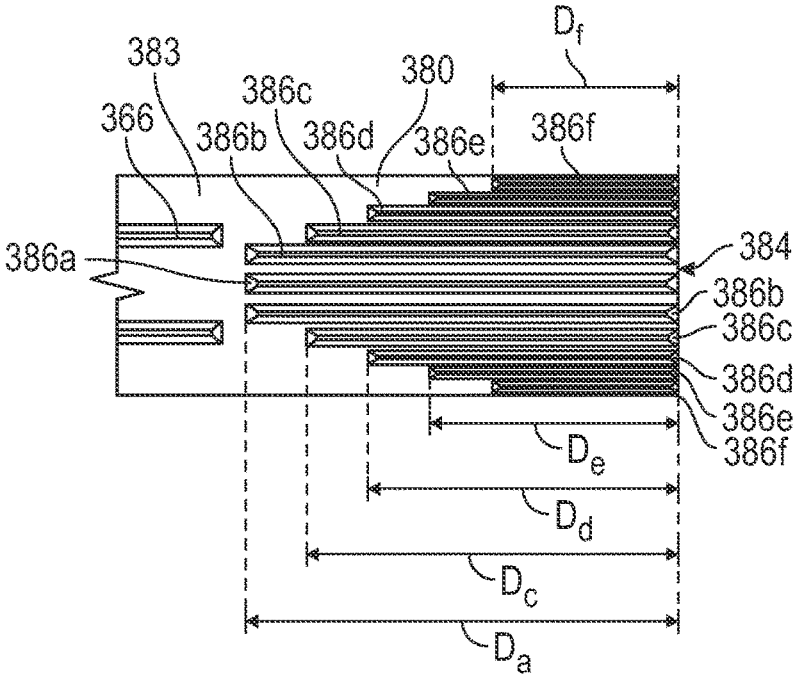
FIG. 7 is a simplified cross section view of the inner surface of a portion of the outer tube showing the fins along line VII-VII from FIG. 6.

FIG. 7 is a cross section view of an inner surface of a portion of the outer tube. The fins 386 can extend from the outer tube outlet 384 towards the outer tube inlet 382. The fins 386 can include a first fin 386*a*, a second fin 386*b*, a third fin 386*c*, a fourth fin 386*d*, a fifth fin 386*e*, and a sixth fin 386*f* The fins 386 can include additional fins 386 such as a seventh fin, an eight fin, a ninth fin, and further additional fins 386.

The first fin 386*a* can extend from the outer tube outlet 384 at a distance of Da. Second fins 386*b* can be disposed circumferentially proximate to the first fin 386*a*. The second fins 386*b* can extend from the outer tube outlet 384 at a distance of Da.

The third fins 386*c* can be disposed circumferentially proximate to the second fins 386*b*, opposite from the first fin 386*a*. The third fins 386*c* can extend from the outer tube outlet 384 at a distance of Dc.

The fourth fins 386*d* can be disposed circumferentially proximate to the third fins 386*c*, opposite from the first fin 386*a*. The fourth fins 386*d* can extend from the outer tube outlet 384 at a distance of Dd.

The fifth fins 386*e* can be disposed circumferentially proximate to the fourth fins 386*d*, opposite from the first fin 386*a*. The fifth fins 386*e* can extend from the outer tube outlet 384 at a distance of De.

The sixth fins 386*f* can be disposed circumferentially proximate to the fifth fins 386*e*, opposite from the first fin 386*a*. The sixth fins 386*f* can extend from the outer tube outlet 384 at a distance of De.

Though the fins 386 are shown as a specific set of lengths, the fins 386 may vary in length and position or may have the same length as other fins 386. Alternatively the fins 386 do not have to be continuous along their length. The fins 386 can be broken up into several segments along the air tube axis 355. The fins 386 can be individually projects oriented in an organized matrix or as a dispersed pattern.

Figure 8:
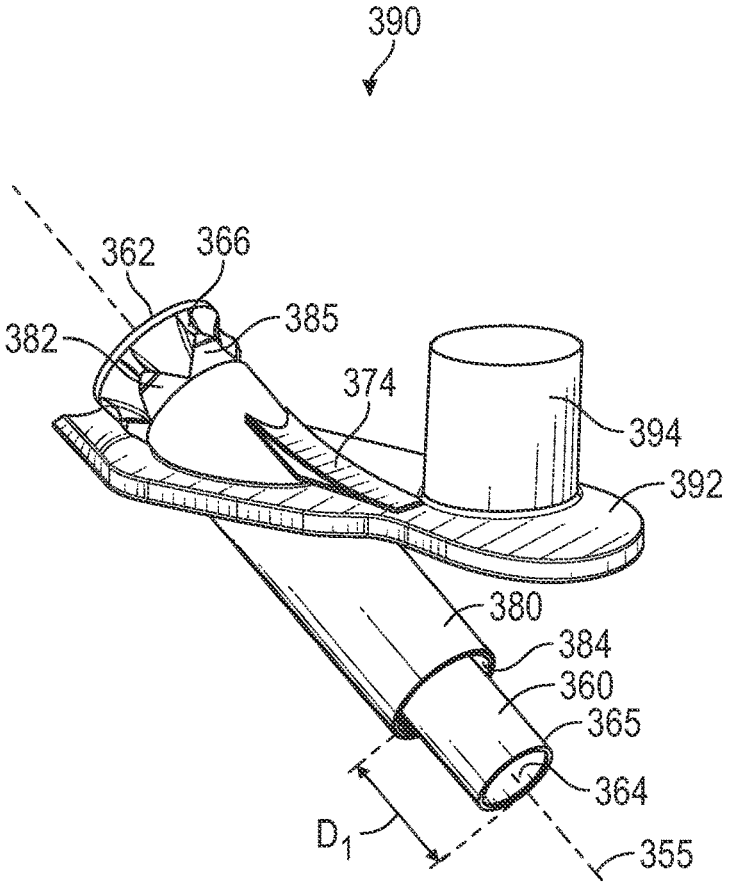
FIG. 8 is a perspective view of an alternative air tube embodiment.

FIG. 8 is a perspective view of an alternative air tube embodiment. Air tube 390 has similar features to air tube 350 and the descriptions of the features shown in previous figures can be applied again to the similar referenced features shown in FIG. 8. Air tube 390 can include an outer plate 392. The outer plate 392 can be circumferentially connected to the outer tube 380. Air tube 390 can include an igniter tube 394 extending through and away from the outer plate 392. The igniter tube 394 can be shaped as a hollow cylinder. The igniter tube 394 can be formed to accept an igniter.

INDUSTRIAL APPLICABILITY

During operation a gas turbine engine 100 combusts a fuel-air mixture in a combustion chamber 320 of a combustor 300 and drives one or more turbines 400 with the resulting hot combustion gas. The high temperatures of the combustion gas can cause wear and potential damage to various components within the gas turbine engine 100. In some gas turbine engines 100, the combustor 300 can include air tubes 350, 390.

The air tubes 350, 390 are formed and can be positioned to receive post compressor discharge air. The post compressor discharge air can be routed into the inner tube inlet 362 and the outer tube inlet 382 and exit the inner tube outlet 364 and outer tube outlet 384, respectively. In other words the inner tube 360 and outer tube 380 can form dual concentric flow circuits for delivering discharge air from the compressor 200 to the combustion chamber 320. The outer plate 370 can be angled with respect to the outer tube 380 which can angle the air tube 350, 390 into position with the outer liner 330 and inner liner 310 such that the exiting air from the inner tube outlet 364 and outer tube outlet 384 provides a tangential swirling motion of the gas within a primary zone of the combustion chamber 320. An embodiment of the air tube 390 can include an igniter tube 394 that is shaped to provide access for an igniter (not shown) to ignite the air and fuel mixture located in the combustion chamber 320.

During operation of the gas turbine engine 100 and within the outer liner 330, the inner tube 360 and outer tube 380 can experience different temperatures, which cause them to undergo thermal expansion at different rates. The struts 366 can connect the inner tube 360 to the outer tube 380 and can experience varying levels of stress in different directions from the differently expanding inner tube 360 and outer tube 380. The height of the struts 366 from the inner tube 360 to the outer tube 380 can be designed shorter to help reduce the stress experienced in the struts. The struts 366 can be formed to position the outer tube 380 with respect to the inner tube 360 at a spacing D3. The spacing D3 can be selected to change the effective area between the outer tube 380 and the inner tube 360 and tune for desired performance characteristics such as to enhance overall combustion performance or for tuning the temperature performance of specific areas and features of the air tube 350, 390 during operation of the gas turbine engine 100. The spacing D3 may be dictated by the effective area required and any assembly constraints for the existing outer liner 330 design. The inner tube 360 can extend beyond the outer tube 380 which provides an emersion depth D1. The emersion depth D1 can be can be selected to tune the temperature performance of air tube 350, 390 features such as the inner tube 360. The emersion depth D1 can be selected to mitigate any potential ignition complications.

The number of struts 366 can be selected to change the effective area between the outer tube 380 and the inner tube 360 and tune the temperature performance of the air tube 350, 390. The struts can also provide the necessary structural support for positioning the outer tube 380 with respect to the inner tube 360. The radial cross sectional area of the struts 366 with respect to the air tube axis 355 can be selected to change the effective area between the outer tube 380 and the inner tube 360 and tune the temperature performance of the air tube 350, 390. The radial cross sectional shape of the struts 366 with respect to the air tube axis 355 can be selected to change the air flow mechanics and tune the temperature performance of the air tube 350, 390. The generally parallel length of the struts 366 with respect to the air tube axis 355 can be selected to tune the temperature performance of the air tube 350, 390. For example, the struts 366 may extend a partial length, the entire length, or beyond the length of the outer tube 380.

The fins 386, 386*a*, 386*b*, 386*c*, 386*d*, 386*e*, 386*f* can be used to increase the surface area of the outer tube 380 and used to improve the temperature performance of the outer tube 380 such as lowering the experienced metal temperatures during operation of the gas turbine engine 100. The number of fins 386, 386*a*, 386*b*, 386*c*, 386*d*, 386*e*, 386*f* can be selected to tune the temperature performance of the air tube 350, 390. The height and arc length L2 of the fins 386, 386*a*, 386*b*, 386*c*, 386*d*, 386*e*, 386*f* can be selected to tune the temperature performance of the air tube 350, 390. The radial cross sectional area of the fins 386, 386*a*, 386*b*, 386*c*, 386*d*, 386*e*, 386*f* with respect to the air tube axis 355 can be selected to tune the temperature performance of the air tube 350, 390. The radial cross sectional shape of the fins 386, 386*a*, 386*b*, 386*c*, 386*d*, 386*e*, 386*f* with respect to the air tube axis 355 can be selected to tune the temperature performance of the air tube 350, 390. The generally parallel length of the fins 386 with respect to the air tube axis 355 can be selected to tune the temperature performance of the air tube 350, 390. The fins 386, 386*a*, 386*b*, 386*c*, 386*d*, 386*e*, 386*f* can be positioned less than 180 degrees with respect to the circumference of the outer tube 380 to reduce the maximum temperature of the outer tube 380 proximate to the higher heat effected zone of the outer tube 380, while minimizing the restriction of flow caused by the reduction in effective area.

The air tubes 350, 390 may be made from a variety of manufacturing methods including the use of sheet metal and brazing or additive manufacturing. Additive manufacturing, also known as 3D printing, can facilitate the manufacturing of desired air tube feature geometry to achieve the desired performance. Additive manufacturing may provide other functional benefits. The surface texture provided by additive manufacturing can allow for a stronger brazing bond between the surface of the outer plate 370 and the outer liner 330 in comparison to brazing with another material such as sheet metal. Additive manufacturing allows for the air tube 350, 390 to be manufacture as one piece, whereas using sheet metal can require brazing multiple pieces of metal together and can create eccentricities that effect temperature performance of the air tube 350, 390.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine 100. For example, the described embodiments may be applied to stationary or motive gas turbine engines 100, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that have any or all of the stated benefits and advantages.

What is claimed is:

1. An air tube for a gas turbine engine including a combustor with an outer liner, the air tube comprising:

an inner tube circumferentially extending around an air tube axis longitudinal to the air tube, having an outer surface, an inner tube inlet, and an inner tube outlet disposed opposite of the inner tube inlet, the inner tube outlet in fluid communication with the inner tube inlet;

an outer plate configured to be connected to the outer liner of the combustor;

an outer tube disposed outward of the inner tube and having an inner surface;

an outer tube inlet proximate the inner tube inlet;

an outer tube outlet opposite the outer tube inlet, the outer tube outlet in fluid communication with the outer tube inlet; and a plurality of fins disposed along the inner surface of the outer tube, extending from proximate the outer tube outlet towards the outer tube inlet and not contacting the inner tube;

a strut extending from proximate the inner tube inlet towards the inner tube outlet on the outer surface of the inner tube and connected to the inner surface of the outer tube; and wherein the plurality of fins are disposed downstream of the strut, in which downstream is relative to an air flow direction within the air tube, and the plurality of fins vary in length with respect to the air tube axis.

2. The air tube of claim 1, further comprising an igniter tube extending through and from the outer plate.

3. The air tube of claim 1, wherein the outer tube inlet and the outer tube outlet are disposed axially between the inner tube inlet and the inner tube outlet with respect to the air tube axis.

4. The air tube of claim 1, wherein the plurality of fins are shaped to be wider adjacent the outer tube than inward of the outer tube.

5. The air tube of claim 1, wherein the inner tube inlet is larger than the inner tube outlet.

6. The air tube of claim 1, wherein the air tube is made of metal and the outer plate has a surface texture created by an additive manufacturing process.

7. An air tube for a gas turbine engine, the air tube comprising:

an outer cylindrical tube having a plurality of fins;

an inner cylindrical tube disposed within the outer tube, having an inner tube inlet and an inner tube outlet opposite the inner tube inlet;

a plurality of struts each extending from proximate the inner tube inlet towards the inner tube outlet and extending from the inner cylindrical tube to the outer cylindrical tube; and an outer plate disposed outward of and circumferentially connected to the outer cylindrical tube, the outer plate formed to be connected to an outer liner of a combustor of the gas turbine engine, wherein the plurality of fins are disposed downstream of the plurality of struts, in which downstream is relative to an air flow direction within the air tube, and wherein the plurality of fins are disposed along an inner surface of the outer cylindrical tube, extending radially inwards toward the inner cylindrical tube and not contacting an outer surface of the inner cylindrical tube, and the plurality of fins vary in length with respect to an air tube axis.

8. The air tube of claim 7, further comprising an igniter tube extending through and from the outer plate.

9. The air tube of claim 7, wherein the plurality of struts are generally circumferentially spaced evenly around the inner cylindrical tube.

10. The air tube of claim 7, wherein the plurality of fins are positioned within 180 degrees of a circumference of the outer cylindrical tube.

11. A combustor for a gas turbine engine, the combustor comprising:

an inner liner circumferentially extending around a center axis longitudinal to the gas turbine engine;

an outer liner disposed outward of the inner liner with respect to the center axis, the outer liner forming a combustion chamber with the inner liner; and an air tube, including an inner tube shaped as a hollow cylinder, a portion of the inner tube extending through the outer liner, having an outer surface, an inner tube inlet disposed radially outward from the outer liner with respect to the center axis, and an inner tube outlet disposed opposite of the inner tube inlet and within the combustion chamber, the inner tube outlet in fluid communication with the inner tube inlet, an outer tube shaped as a hollow cylinder, disposed outward of the inner tube, having an inner surface, an outer tube inlet disposed outward of the outer liner with respect to the center axis, an outer tube outlet opposite the outer tube inlet and disposed with the combustion chamber, the outer tube outlet in flow communication with the outer tube inlet, and a plurality of fins extending from the outer tube outlet towards the outer tube inlet, the plurality of fins extend towards the inner tube;

a strut coupling the outer surface of the inner tube to the inner surface of the outer tube, the strut extending from the inner tube inlet towards the inner tube outlet; and wherein the plurality of fins are disposed downstream of the strut, in which downstream is relative to an air flow direction within the air tube, and the plurality of fins vary in length with respect to an air tube axis.

12. The combustor of claim 11, wherein the air tube further comprises an outer plate disposed outward of and circumferentially connected to the outer tube, the outer plate connected to the outer liner.

13. The combustor of claim 12, wherein the plurality of fins increase a surface area of the outer tube.

14. The combustor of claim 13, wherein the air tube is made of metal and the outer plate has a surface texture created by an additive manufacturing process.

15. The combustor of claim 12, wherein an effective area between the inner tube and outer tube is selected to enhance temperature performance of the air tube.

16. The combustor of claim 12, wherein each of the plurality of fins has a triangular shape.

* * * * *